US005693245A

United States Patent [19]

Clizbe

[11] Patent Number: 5,693,245

[45] Date of Patent: Dec. 2, 1997

[54] ELECTRIC RANGE TEMPERATURE CONTROL WITH MANDATORY TIMER

[76] Inventor: Kent Clizbe, Rte. 2 Box 109, Halifax, N.C. 27839

[21] Appl. No.: 650,269

[22] Filed: May 22, 1996

[51] Int. Cl.[6] ..... H05B 1/02

[52] U.S. Cl. ..... 219/492; 219/493; 219/448; 219/508; 337/11

[58] Field of Search ..... 219/448, 492, 219/493, 497, 501, 506, 719, 720, 508; 337/3, 10, 11

[56] References Cited

U.S. PATENT DOCUMENTS

| | | | |
|---|---|---|---|
| 3,625,197 | 12/1971 | Pirker | 219/413 |
| 3,681,729 | 8/1972 | Elders | 337/3 |
| 4,410,795 | 10/1983 | Ueda | 219/506 |
| 4,849,595 | 7/1989 | Fowler | 219/719 |
| 4,897,526 | 1/1990 | Anthony | 219/492 |
| 5,073,701 | 12/1991 | Ljunggren | 219/448 |
| 5,134,262 | 7/1992 | Lee | 219/10.55 B |
| 5,455,403 | 10/1995 | Kim et al. | 219/702 |
| 5,607,611 | 3/1997 | Lee | 219/720 |

*Primary Examiner*—Mark H. Paschall
*Attorney, Agent, or Firm*—C. J. Husar

[57] ABSTRACT

The disclosure relates to an integral electric range surface burner control switch user interface made up of two components. The first component, which controls the burner temperature setting, is a standard knob which is rotated to turn the burner on, as well as set the desired temperature of the particular surface burner. The second component is a timer control ring integrally mounted around the surface burner temperature control knob. The timer control ring is concentric with and has the same central axis as the surface burner temperature control knob, and is rotatable to set the desired cooking time for the particular surface burner. When the selected amount of time expires, the power to the surface burner element is automatically disconnected and the surface burner is disabled, thus requiring a resetting of the timer for further use.

10 Claims, 4 Drawing Sheets

ELECTRIC RANGE TEMPERATURE CONTROL WITH MANDATORY TIMER

BACKGROUND OF THE INVENTION

The invention relates to electric range surface burner controls. More specifically, it relates to an integral electric range surface burner control which comprises two components, a mandatory timer control and a burner temperature control. As a prerequisite to operating the surface burner element, the timer control must first be set for a desired period of time. It is only after the timer is set, that supply power is allowed to flow to the burner temperature control and subsequently to the surface burner element.

The timer device provides cooking times from zero to sixty minutes per setting. Upon expiration of the set period of time, an interface switch is opened and the flow of electrical current to the surface burner element is terminated.

As is well known, unattended cooking and use of electric ranges causes more than 100,000 household fires each year in the United States. The losses in property damage due to these fires is in excess of 800 million dollars and the loss of lives exceeds 300 deaths with over 5,000 injuries suffered from severe burns to the body. Frequently, these losses include many young children as part of these statistics. Therefore, it can readily be seen that any product which can serve to reduce these statistics will receive strong approval from the safety conscious public.

With these statistics in mind, applicant has developed a user-friendly combined burner control which has a surface burner temperature control as is presently found on most ranges and is additionally provided with a concentrically positioned timer control ring therearound. The time settings are incremental from zero to sixty minutes with additional cooking time available by merely resetting the timer. However, the timer ON/OFF switch is open until the timer is set. Upon expiration of the selected time period, the timer control opens the ON/OFF switch controlling power to the burner temperature control and ultimately to the surface burner heating element, thus requiring the timer to be reset for any additional cooking time.

DISCUSSION OF THE PRIOR ART

Most, if not all, of today's cooking ranges are provided with timers. However, none of the timers presently available to the public are integral with the temperature control to initiate and terminate the power supply to the surface burner element. The known prior art timers are remotely located and merely serve as a convenient timer for alerting the user that the previously set time period has expired and the user is required to take the necessary action required at that particular time. If, at the precise moment that the time expired and the buzzer has sounded, the front door bell has rung, or the telephone rings, or some other unexpected event occurs, the unattended burner element will continue on at the temperature originally set and possibly result in becoming another household fire statistic.

Another type of timer which is currently available on most electric ranges is the timer control associated with the range oven whether it be for cleaning or baking purposes. However, the oven can still be operated for baking purposes without the use of the timer since it has no built-in supervisory control over the oven heating element at these times and the use of the timer is not mandatory to energize the oven heating element. U.S. Pat. No. 3,038,040, issued to Solle et al, discloses a timer which is used to control the oven heating element of a range. This patent discusses the typical problems encountered by the user due to the multi-step procedure which often requires use of the instruction booklet to operate the oven timer control and proposes a so-called "simplified" device which still requires three different control functions including first, an outward pulling motion, second, a rotary motion, and, third, an inward pushing motion. Thus, it can be seen that although Stolle et al, '040 has reduced the number of steps previously required, it remains a counter-intuitive design which requires significant thinking on the part of the user and therefore, makes it very difficult to use. U.S. Pat. No. 3,038,041, issued to Zagorski, discloses a timer device which is used to control the oven of an electric range. This patent discloses a complicated device which utilizes a separate timer 40 with "start" and "stop" dials for controlling the operation of the timer. U.S. Pat. No. 3,446,922, issued to Voigt, Jr. et al., discloses a combined timer and rotary selector shaft wherein camshaft 14 includes a plurality of cams 16,17,18,19 for operating associated switches. U.S. Pat. Nos. 3,967,097, 4,695,683 and 4,835,349 are more recent examples of automatic shut-off appliance timers. Each of these patents discloses a complicated gearing mechanism while failing to provide an integral timer and temperature control which has an intuitive user interface that requires the setting of the timer control before the power is permitted to flow to the selected burner temperature control.

SUMMARY OF THE INVENTION

The present invention provides a novel control interface arrangement comprising a burner temperature control knob rotatable within an integral timer control ring, combined wih a mandatory time feature, i.e. the timer control must first be set before power is permitted to flow to the burner temperature control and subsequently to the surface burner element. The juxtapositioning of the timer control ring with respect to the burner temperature control knob provides a user-friendly, intuitive user interface. The invention contemplates the use of a separate timer for each burner temperature control unit and extends the intuitive location of the burner temperature control user interface to the timer user interface. Convenience of use and mandatory use of the timer, combined with automatic burner shut-off, virtually eliminates accidents caused by users leaving burners on while falling asleep, leaving the kitchen, or leaving the burner unattended for any of a multitude of everday reasons. The intuitive placement of the user interface guarantees that users will readily adapt to the idea of a timer controlled range-top burner element and appreciate the added measure of safety provided thereby.

OBJECTS OF THE INVENTION

An object of the invention is to provide an integral surface burner control which will significantly reduce the number of household fires due to unattended surface burners.

Another object of the invention is to provide an integral surface burner control wherein setting of the timer is a prerequisite to energizing the burner temperature control.

A further object of the invention is to provide an integral surface burner control which is user friendly and includes an intuitive user interface.

A still further object of the invention is to provide an integral surface burner control wherein the temperature control is surrounded by a convenient user-friendly concentric ring to control timer operation.

Yet another object of the invention is to provide an integral surface burner control with a dedicated timer and timer control ring for each of the plurality of surface burners found on most ranges.

A further object of the invention is to provide an integral surface burner control whereupon expiration of a selected time period the surface burner is automatically disabled.

These and other objects of the instant invention will become more apparent hereinafter. The instant invention will now be described with particular reference to the accompanying drawings which form a part of the specification wherein like reference characters designate the corresponding parts throughout the several views.

DETAILED DESCRIPTION OF THE DRAWINGS

Figure 1:
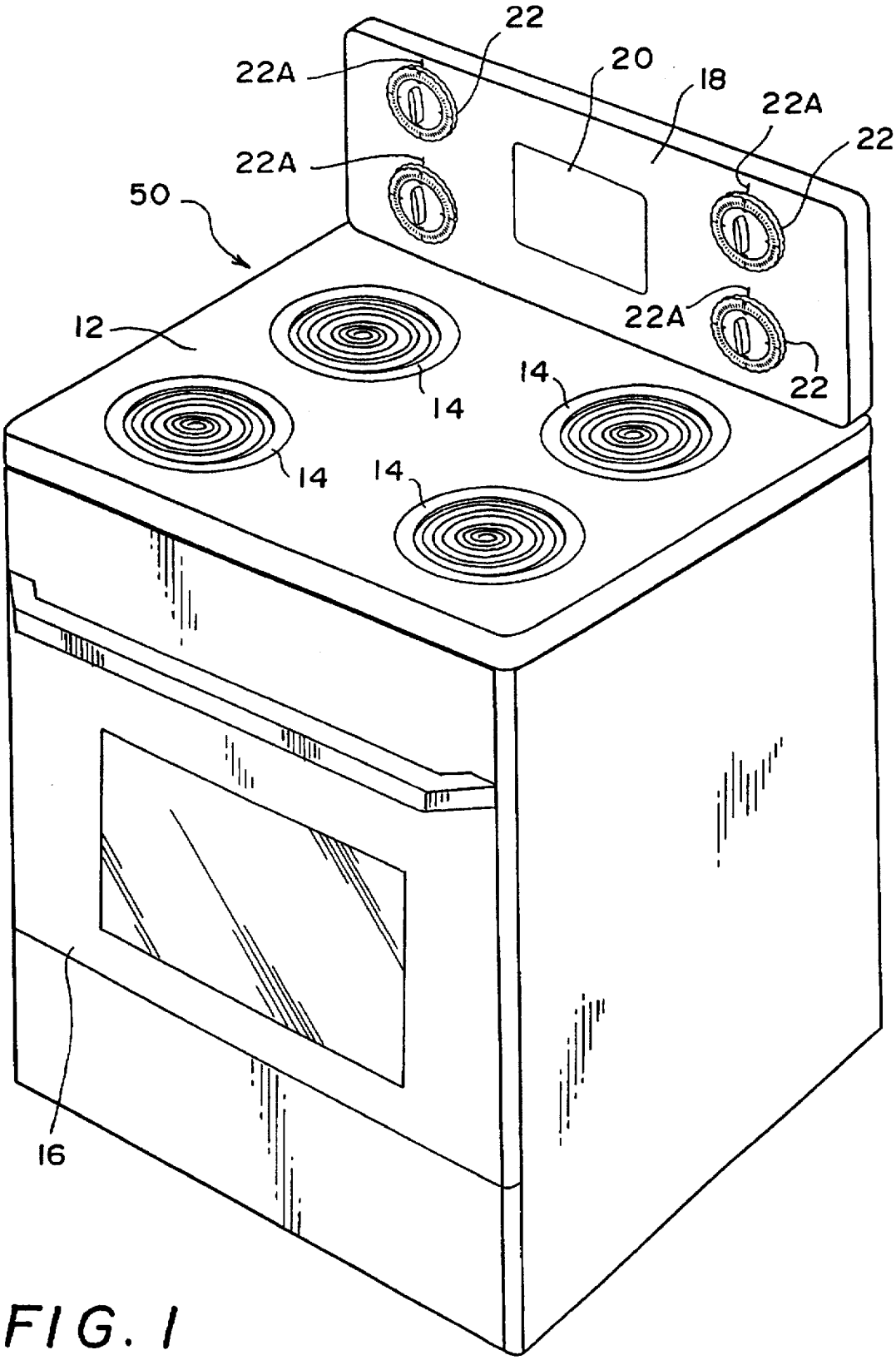
FIG. 1 is a perspective view of a four surface burner electric range illustrating placement of the novel integral timer and temperature surface burner controls.

Referring now to FIG. 1, there is shown a perspective view of a conventional electric range indicated generally by reference numeral 50. As illustrated, it has the usual range top cooking surface 12 with four electric surface burners 14 and a baking oven/broiler enclosed by door 16. Raised range panel 18 includes a centrally located control panel 20 which includes various control switches such as fan, lights, oven controls and other assorted items. Control panel 20 does not form a part of the subject invention and accordingly, no further details are provided. Raised range panel 18 also includes four conveniently located integral timer and temperature surface burner controls 22 which will be discussed in greater detail with regard to subsequent figures. A stationary OFF reference point 22A is provided for each of the controls 22. Suffice it to say, integral timer and temperature burner controls 22 are strategically located in relation to the particular surface burner 14 that it controls.

Figure 2:
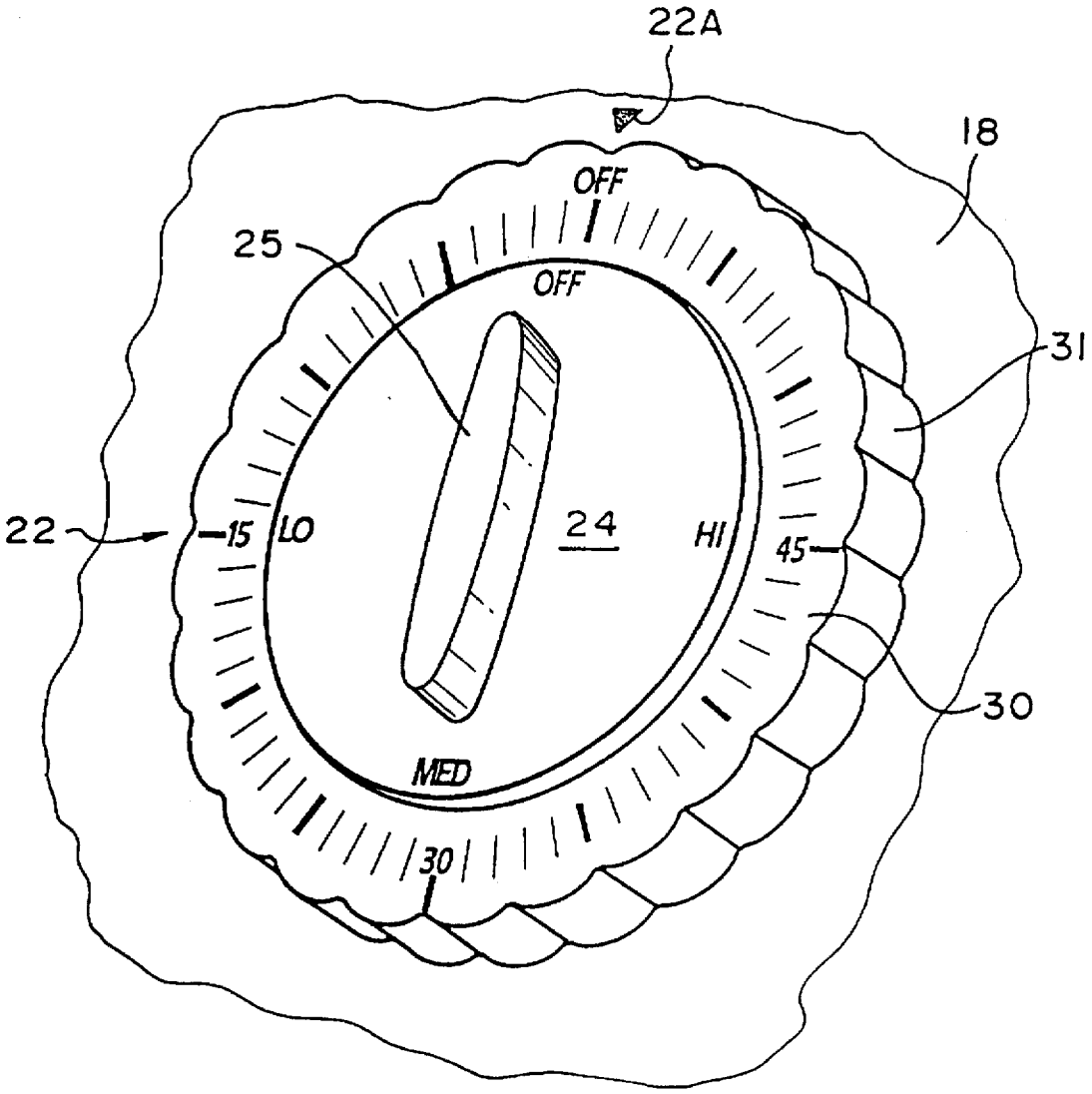
FIG. 2 is an enlarged view of the integral timer and temperature control unit illustrating the intuitive location of the surface burner temperature control user interface in relation to the timer user interface, thus making it extremely user friendly.

Referring now to FIG. 2, there is shown an enlarged view of the integral timer and temperature surface burner control 22 and a portion of raised panel 18 with stationary OFF reference point 22A thereon. As illustrated, center ring 24 includes a raised grasping portion 25 and controls the temperature level of the particular surface element 14. Upon rotation of center ring 24 in a clockwise direction until the LO marker is aligned with stationary marker 22A of raised panel 18, surface element 14 would be energized to the low temperature setting. Further rotation of center ring 24 to the medium or high temperature indicators would likewise set the surface burner element to the selected temperature level. Concentric with and immediately adjacent to temperature center ring 24 is rotatable timer control ring 30 with time graduations from zero to sixty minutes. The outer periphery of timer control ring 30 is provided with scallops 31 about its entire periphery thereof. The purpose of scallops 31 is to provide a comfortable gripping surface for the user. To set the desired time period for a surface burner element 14 to be energized, the user merely places his hand on timer control ring 30 and rotates it clockwise until the desired numerical time period of rotatable timer control ring 30 is aligned with stationary marker 22A on raised panel 18. Since timer control ring 30 has a maximum of sixty minutes thereon, time periods in excess of sixty minutes are obtained by successive setting after the previous period has expired.

As indicated earlier, timer control ring 30 must be rotated to a desired period of time followed by rotation of temperature surface control center ring 24 to the desired temperature level before the particular surface burner element 14 will be energized.

Figure 3:
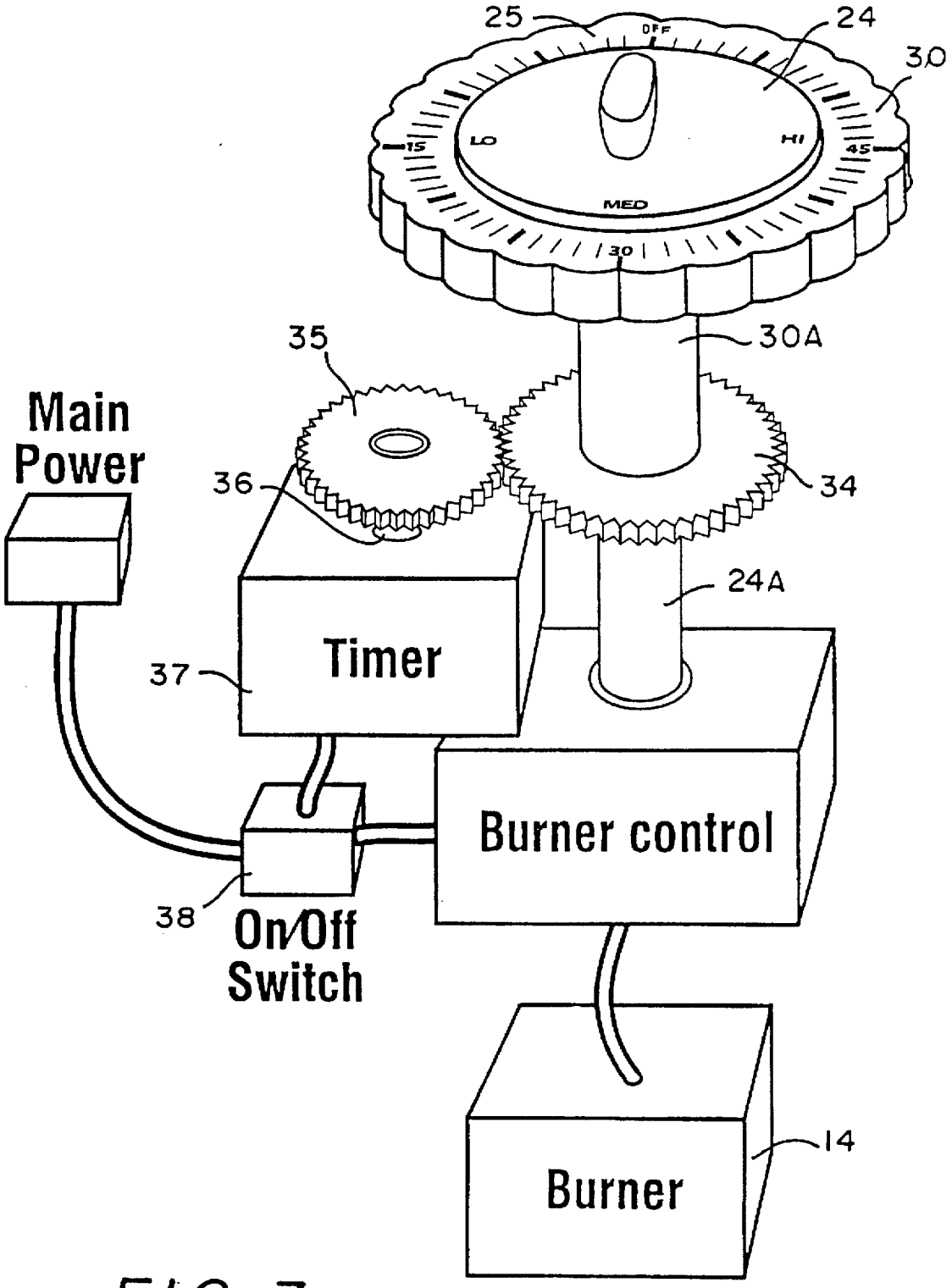
FIG. 3 is a schematic illustration of the novel integral timer and surface burner temperature conrol unit as it relates to the main power supply and surface burner element.

Referring now to FIG. 3, there is shown center ring 24 which has shaft 24A operably connected to the burner temperature control which sets the temperature level for burner element 14. Concentric with shaft 24A is timer shaft 30A which drives a first timer gear 34. Meshing with first timer gear 34 is a second, smaller timer gear 35 having an output shaft 36 which drives the timer. The output of the timer operates the on/off switch 38 which controls the main power supply to the burner temperature control and ultimately burner element 14.

Upon setting the desired time period by rotating timer contol ring 30, shaft 30A rotates gears 34 and 35 to set the desired time period, whereupon, on/off switch 38 is closed, allowing power to flow to the burner temperature control. Upon expiration of the timer setting, timer on/off switch 38 opens and terminates the supply of power to burner temperature control and burner element 14.

Figure 4:
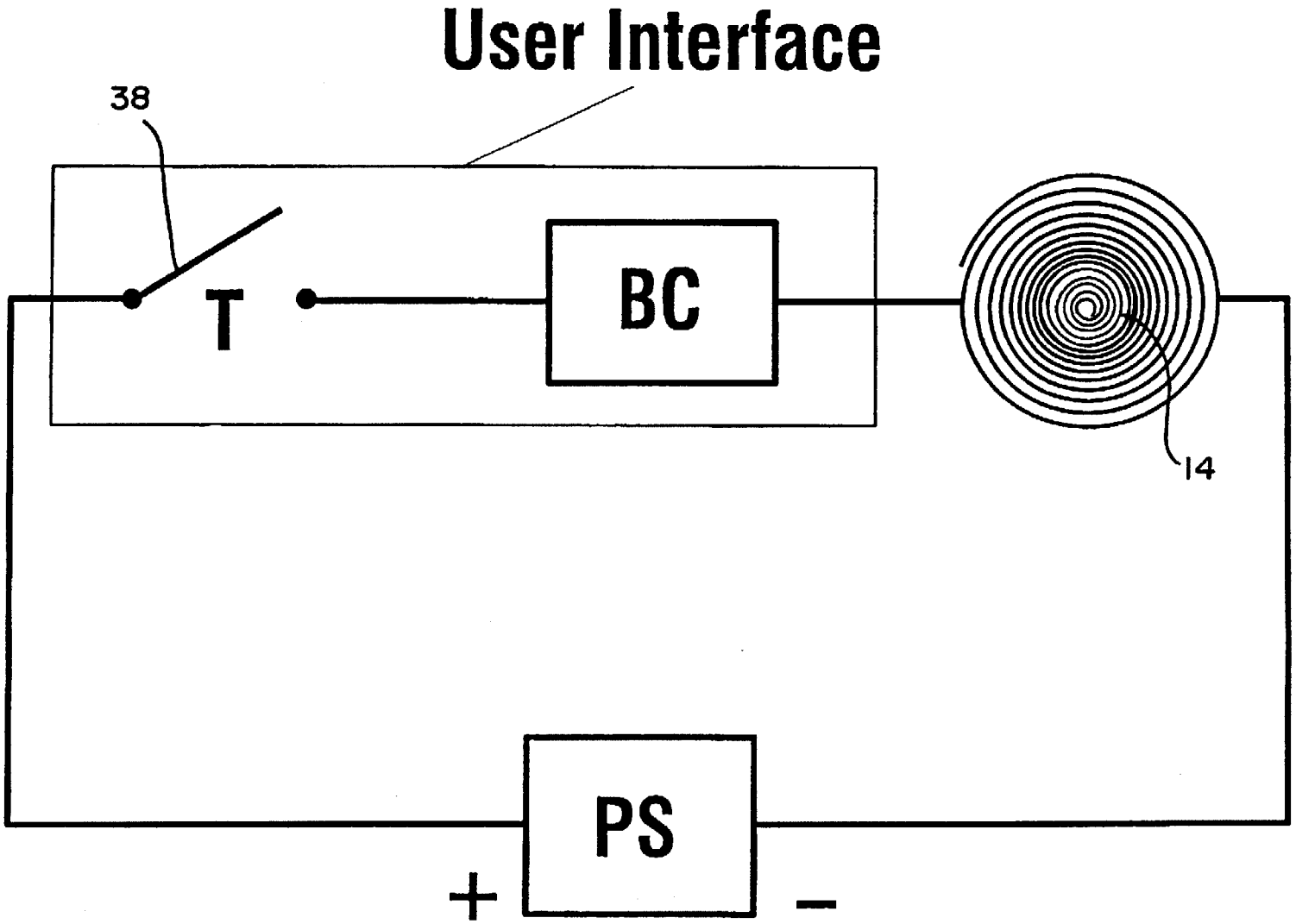
FIG. 4 is an electrical schematic of the user interface illustrating the timer disconnect and surface burner temperature control as related to the power supply and the surface burner element.

FIG. 4 is a schematic of the electrical circuit showing the flow of power from the supply to timer on/off switch 38, then to temperature burner contol BC, burner element 14 and back to the power supply PS, completing the circuit.

By way of review, the operation of the novel combined timer and temperature control 22 is as follows. First, timer control ring 30 is rotated to the desired cooking time whereupon timer on/off switch 38 is closed, allowing current to flow to the burner temperature control BC. Next, temperature control ring 24 is rotated to correspond to the desired temperature level for the particular burner element 14. At the expiration of the selected time period, on/off switch 38 opens and terminates the supply of power to burner element 14.

While the invention has been described in its preferred embodiment, it is to be understood that the words which have been used are words of description rather than limitation and that changes may be made within the purview of the appended claims without departing from the full scope or spirit of the invention.

Having thus described my invention, I claim:

1. An electric range surface burner control comprising:

a combined timer and temperature unit having separate dial means for selecting the time period of use and temperature level of a selected surface burner;

timer means operably connected to said timer dial means for controlling the power supply circuit;

burner temperature control means operated by said temperature level dial means for controlling the temperature of said surface burner element; wherein said timer dial means must be set to a selected period of time to complete the power supply circuit to said burner control means whereby the setting of the timer dial means initiates the connection of the power supply circuit to said temperature control means and upon expiration of said selected time period, said timer means opens the power supply circuit and terminates the power to said burner temperature control means and said burner element.

2. An electric range surface burner control as defined in claim 1 wherein said timer dial means comprises a rotatable dial ring having incremental time periods thereon; said dial ring including a user-friendly peripheral surface for ease of use with said incremental time periods referenced by a stationary marker on a supporting mounting surface.

3. An electric range surface burner contol as defined in claim 2 wherein rotation of said timer dial ring beyond said stationary marker activates the timer for the selected time period and simultaneously closes an on/off switch completing the power supply circuit.

4. An electric range surface burner control as defined in claim 3 wherein said timer dial means further comprises a shaft operably connected to said rotatable dial ring with said shaft supporting a first drive gear which is intermeshed with a second drive gear; said second drive gear positioned in offset relation to said first drive gear;

said second drive gear operably connected to a shaft which activates the timer mechanism that operates said on/off switch for controlling the power supply.

5. An electric range surface burner control as defined in claim 2 wherein said temperature dial means comprises a rotatable dial concentrically mounted within said timer dial ring; said temperature dial having a raised knob portion for rotating said temperature dial ring; said temperature dial ring further including temperature level settings which are operable when said temperature dial ring is rotated relative to a stationary reference marker on a supporting surface after the setting of a desired time period.

6. An electric range surface burner control as defined in claim 5 wherein said temperature dial ring also includes an OFF setting which terminates the power supply to a surface burner element when rotated into alignment with said stationary reference marker and turns the power ON when rotated out of alignment with said stationary reference marker provided that said timer dial has previously been rotated to a desired period of time.

7. An electric range surface burner control as defined in claim 6 wherein said temperature dial means further comprises an output shaft having a first and second end which has the same axis of rotation as said temperature dial ring;

said first end of said output shaft is operably connected to said temperature dial ring and said second end of said output shaft is operably connected to said burner control whereby rotation of said temperature dial ring, after setting a desired time period, automatically sets the desired temperature level of a selected surface burner element.

8. An electric range surface burner conrol as defined in claim 6 wherein said stationary reference marker is a common marker for use by said timer dial and said temperature dial.

9. An electric range surface burner interface control circuit comprising:

power supply means;

timer controlled on/off switch means for controlling said power supply means;

and burner temperature control means for controlling the temperature level of a surface burner element;

wherein said timer controlled on/off switch must be in its closed position before power is supplied to said surface burner temperature control means and said surface burner element and when said timer controlled on/off switch is in its open position, power supply is terminated to said burner temperature control means and said surface burner element is disabled whereby the setting of said timer dial initiates the connection of said power supply means to said burner temperature control means.

10. An electric range surface burner interface control circuit as defined in claim 9 wherein said timer controlled on/off switch means is in series with said burner temperature control means.

* * * * *